United States Patent [19]

Rivers et al.

[11] Patent Number: 4,532,873

[45] Date of Patent: Aug. 6, 1985

[54] SUSPENSION FIRING OF HOG FUEL, OTHER BIOMASS OR PEAT

[75] Inventors: John Rivers, Normandy Park; Charles D. Kramer, Montesano; Robert L. Cox, Hoquiam, all of Wash.

[73] Assignee: Weyerhaeuser Company, Tacoma, Wash.

[21] Appl. No.: 580,407

[22] Filed: Feb. 15, 1984

Related U.S. Application Data

[63] Continuation-in-part of Ser. No. 377,279, May 12, 1982, abandoned.

[51] Int. Cl.[3] ..... F23D 1/00; C10L 5/44

[52] U.S. Cl. ..... 110/347; 44/1 D; 110/224; 110/263; 110/265

[58] Field of Search ..... 110/347, 263, 265, 221, 110/224; 44/1 D

[56] References Cited

U.S. PATENT DOCUMENTS

| | | | |
|---|---|---|---|
| 2,148,447 | 2/1939 | Dundas et al. | 110/224 |
| 3,285,523 | 11/1966 | Duyckinck et al. | 241/53 |
| 3,826,208 | 7/1974 | Williams | 110/224 |
| 3,831,535 | 8/1974 | Baardson . | |
| 3,858,535 | 1/1975 | Shiba | 110/224 |
| 4,229,183 | 10/1980 | Eneroth et al. | 44/1 D |
| 4,235,174 | 11/1980 | Spurrell | 110/346 |
| 4,250,820 | 2/1981 | Lantenschlager | 110/265 |
| 4,325,327 | 4/1982 | Kantesania et al. | 110/263 |
| 4,326,470 | 4/1982 | Maranhao | 110/224 |
| 4,333,405 | 6/1982 | Michelfelder et al. | 110/265 |

OTHER PUBLICATIONS

Fagerlund; "How Some Scandinavian Mills Get Higher Fuel Value from Bark", Tappi; vol. 63, No. 3, 3/1980, pp. 35–36.

"Pulverizing Machinery", Division of Mikropul Corp., brochure.

*Primary Examiner*—Henry C. Yuen

[57] ABSTRACT

A method is described for preparing hog fuel, other biomass, or peat for efficient burning and heat recovery in a water-wall boiler. The process requires drying the fuel to less that a 30% moisture content. The fuel is then pulverized to an upper particle size such that there are substantially no particles which will not burn in air suspension within the confines of the combustion zone and the boiler can meet emission requirements. Additionally, the pulverizing step is adjusted such that a fines portion of fuel is created of such size and in such amount that the fines portion readily self-ignites upon flame initiation. The fines provide sufficient ignition energy so that the entire flow of fuel burns without the necessity of the conventional fossil fuel support or pilot. The fuel is sized to burn in air suspension by injection into the boiler through a swirl stabilized-type burner. For one burner, not particularly optimized for burning wood, a suitable particle size range was found to comprise 65–100% less that 1000 microns and 15–85% less that 150 microns. Pulverizing is carried out preferably at low air flows so that the resulting air and pulverized fuel mixture of about 1–2 kilograms air per kilogram fuel may be directly injected by the swirl stabilized air suspension type burner into the furnace along with secondary air. Combustion in the furnace requires no supplemental or pilot fuel to maintain stability. The process has good load following characteristics having at least a 2.5:1 turndown ratio.

8 Claims, 5 Drawing Figures

SUSPENSION FIRING OF HOG FUEL, OTHER BIOMASS OR PEAT

This application is a continuation-in-part of application Ser. No. 377,279 filed May 12, 1982, now abandoned.

BACKGROUND OF THE INVENTION

1. Field of the Invention

This invention deals with heat recovery from wet wood waste or other biomass material and certain fuels such as peat. Of particular interest is wood waste generated by wood processing facilities, commonly called "hog fuel".

2. Description of the Prior Art

In the past few years as fossil fuel costs have escalated, operators processing wood as a raw material, especially in sawmills, pulp and composite wood products operations, have become more interested in recovering the heating value of wood wastes that are otherwise unsuitable for conversion into salable products. Many facilities generate a sufficient amount of such waste to meet significant portions of the energy requirements of the facility. Others have access to supplies of peat which, if a suitable means of heating value recovery was available, could constitute a low cost replacement for fuel oil or natural gas.

Wood wastes from sawmilling and related raw wood handling operations have a number of characteristics that make efficient recovery of heating values difficult. Hog fuel is generally wet, substantially in excess of 50 percent by weight moisture and often in excess of the 68% moisture limit of self-sustaining combustion. Each mill source of waste has its own characteristic moisture content. A major source of waste is hydraulically removed bark, for example. While sawmill wastes such as sander dust, sawdust and shavings are relatively drier, they are usually accumulated and stored out in the weather and thus soak up rainwater during wet periods of the year.

A second problem with hog fuel is that it is very irregular in particle size distribution. Hog fuel wastes are generated from every wood handling and processing operation. The wastes range from sander dust of 0.1–3 mm diameter particle size to bark and low yard debris which may exceed dimensions of several inches in diameter by several feet in length.

A common practice in the past has been to burn wet hog fuels "as is", on a grate in a combination oil-wood waste boiler. Supplemental oil is generally used to sustain combustion and permit the boiler to follow process demands for steam. Peat and other biomass matter are similar to hog fuel in that they are wet and of unsuitable physical form or size. Thus, these potential fuels are generally not utilized in many parts of the world. While the discussion here focuses upon wet wood waste or hog fuel, the invention is applicable to any wet organic vegetable matter.

Recent improvements in heat recovery from hog fuel require a reduction in moisture content of the hog fuel before it is fed to the boiler. Studies show that reducing the initial moisture content of the fuel improves steam production and reduces boiler stack emissions. The hog fuel burning process need no longer supply all the latent heat necessary to dry the fuel. The dry fuel requires less excess air and thus boiler heat losses are reduced, improving overall thermal efficiency. The resulting high combustion zone temperatures apparently insure incineration of particulate matter before it escapes out the stack.

A state-of-the-art process that successfully accomplishes the pre-drying and burning of hog fuel is described by Spurrell in U.S. Pat. No. 4,235,174, issued Nov. 25, 1980 and assigned to Weyerhaeuser Company. In this process a portion of the largest size material from the hog fuel pile is combusted in a fluid bed burner. The products of combustion from the fluid bed are then used to dry the balance of the hog fuel pile in a rotary dryer before it is fed into a combination oil-wood waste boiler. The dried fuel is separated by size. The coarse fraction, at about 35 percent moisture burns on a furnace grate while a fines fraction at 15 percent moisture and a particle size of less than ⅛ inch (3175 microns) diameter is injected in air suspension into the boiler.

The Spurrell process, however, requires an oil pilot on the injected fines portion of the fuel in order to sustain stable combustion. The oil pilot represents a substantial use of fossil fuel, up to 30% of the total burner rating in terms of BTUs per hour at full burner loads. This usage of expensive fossil fuel is particularly unsatisfactory since it is not needed for its energy value per se but only to serve as an ignition energy source to achieve stable burning of the hog fuel material.

Attempts to burn the dried fines stream produced in the Spurrell process in air suspension without pilot or fire on the grate have been generally unsuccessful. Trial burns of this material, which is about 100 percent minus 3175 microns in size, would not sustain stable combustion without an oil pilot. Even with the pilot, overall furnace conditions were unstable, producing large swings in boiler pressures, unless a grate fire was present.

Certain wood wastes have in the past been recognized as burnable in furnaces without oil support or grate. For example, sander dust which is of very fine particle size distribution and about 5% moisture content has been burned successfully in air suspension. Schwieger, in an article entitled "Power from Wood", Power, Vol. 124, No. 2, p 51–32 (February 1980), describes sander dust, at about 12% moisture, as being fired to a package boiler. The average size of this material is said to be about 793 microns. Even so an oil pilot is recommended, suggesting unstable combustion conditions.

Special materials such as sander dust, however, generally constitute only a very minor portion of the hog fuel pile which accumulates at the typical lumber mill, particularly those integrated with pulp production facilities. The amounts of these special dry, fine wood wastes at most facilities are not, in general, sufficient to meet a significant percentage of the energy requirements of the typical mill. At many facilities generating wood wastes, however, the hog fuel pile as a whole has this capability.

Certain larger size and higher moisture ranges of wood material can be burned without oil support in refractory lined furnaces or kilns. In a refractory furnace the firebox is lined with ceramic which attains a temperature of roughly 1500° F. or higher. The hot gases then contact the steam generating tubes. The heat retained by the mass of ceramic is continually reradiated to help sustain stable combustion in the fire box, permitting otherwise difficult to burn materials or wastes to be burned without oil support. Refractory furnaces have a high initial cost and the effects of high firebox temperatures result in high maintenance costs.

Again, only a small portion of the hog fuel pile is of suitable size for such combustion.

Industry, because of lower capital costs of construction and lower maintenance costs, favors the use of "water wall" boilers wherein the flame is substantially surrounded by water tubes which generally reach only about 600° F. In these boiler configurations, the walls are relatively cold compared to the flame and are heat absorbers. Thus, there is reduced radiation assistance from firebox ceramics to help sustain the ignition process. As a result, water wall boilers are incapable of sustaining suspension firing of conventionally available hog fuel size ranges without the use of a fossil fuel pilot to provide ignition energy to continually raise the air-fuel mixture to ignition. Ignition occurs when a sufficient level of volatiles is generated from the fuel and the volatiles are mixed with air and heated to ignition temperature.

The most recent approach to burning the larger fraction of the hog fuel pile has involved pulverizing the hog fuel to a smaller particle size range. However, because of its fiber content hog fuel is inherently more difficult to pulverize than coal, for example. Eneroth, et al. in U.S. Pat. No. 4,229,183 teach improved hog fuel burning by simultaneously drying the fuel to 10–15% moisture and grinding it to a finely distributed or powder state. The flow from the pulverizer enters a cyclone which separates the fuel from the air flow. The fuel is then re-suspended in air and injected into a boiler. No grate is required. Fagerlund, in "How Some Scandinavian Mills Get Higher Fuel Value From Bark", TAPPI, Vol. 63, No. 3, pp. 35–36 (March 1980) describes the Eneroth method as grinding the wood fuel down to a particle size of 1–3 millimeters (1000–3000 microns). An oil pilot equivalent to 5% of the burner rating is recommended for flame control. Fagerlund notes that control systems in the future will be developed so that no auxiliary oil will be needed.

In another hog fuel burning system, described by Baardson in U.S. Pat. No. 3,831,535, wood waste is dried and pulverized to a maximum particle size of 5/16" or 7940 microns. This material is accumulated in a bin and injected for combustion in a refractory lined chamber where radiation from the refractory provides support for stabilized combustion.

SUMMARY OF THE INVENTION

The present invention converts the entire hog fuel pile or any other coarse or poorly graded biomass or even peat into a fuel that burns in air suspension in a boiler without the necessity for supplemental supporting fossil fuels, hot refractories or grate burning, in contrast to the prior art. The fuel preparation and method of burning the resulting fuel system can be used to fire kilns, product dryers, and particularly water wall furnaces or any other "cold" wall type of heat recovery processes.

A principal object of the fuel preparation method of this invention is to provide a properly dried and sized hog fuel which upon discharge from a pulverizer may be fed to an air suspension burner of the swirl stabilized type and efficiently burned therein. The invention permits a steam-producing boiler to follow varying energy process demands as effectively as oil or pulverized coal firing. In fact, the method of the invention compares substantially more favorably with firing #6 oil than coal because of wood's greater volatiles content and volatility rate. The ash produced is somewhat greater in amount but sulfur dioxide emissions are relatively insignificant, a major advantage in view of concerns about acid rain. $NO_x$ emissions are also less than for coal or oil which is a concern of the utilities and other boiler operators subject of environmental scrutiny and regulation.

The principal achievement of the invention is elimination of the oil pilot necessary to provide ignition energy to sustain stable combustion of wood wastes in water wall boilers, which is characteristic of the prior art. Present commercial wood burners specify that 5–15% of the burner BTU design load must be met by oil or other conventional fossil fuel in order to maintain flame stability.

Another primary object of the invention is the elimination of the grate prior art boilers required to burn oversize material that does not burn in suspension. All of the hog fuel may be burned in air suspension, which system has an excellent capability for turning up or down to meet changing process demands. A burner turn down of at least 2.5:1 is attained.

It is an object of this invention to be able to retrofit the methods of the invention to existing hog fuel boilers having grates or pulverized coal boilers with resultant fuel cost and capital savings. The burning process and apparatus of this invention will operate similarly to a utility boiler burning pulverized lignite or oil.

The system of this invention permits a substantial savings in operating costs over conventional systems through substitution of cheaper wood for oil or coal. Also, elimination of the grate eliminates an industry restriction on maximum size of boilers due to grate size limits. Also, boiler size may be reduced because the fuel is dried prior to firing.

The invention requires drying the hog fuel, which in general has an initial moisture content of 50% or more. Drying may involve mechanical or thermal processes so long as a moisture content of less than about 30% by weight results. About 15–20% weight moisture content is preferred.

The hog fuel is then pulverized to a particle size distribution including: (a) no particles larger than will substantially burn within the confines of the heat recovery boiler and achieve emissions limitations; and (b) a fines portion of such particle size and in such amount that the fines portion self-ignites and provides sufficient ignition energy to sustain stable combustion of the entire fuel flow.

All drying is substantially accomplished prior to the pulverizing step since it is easier to pulverize dry wood to the degree required in the later step.

The upper size limit of the pulverized wood is a function of the boiler employed to burn the prepared fuel and emission limitations prevalent. An upper limit of 65–100% less than 1000 microns has been found suitable for hog fuels burning in a boiler without a grate. Where the boiler includes a grate the upper size limitation is less strict. Most oversize in such case will just fall to the grate.

The characteristics of the necessary fines portion of the pulverized fuel are a function of the moisture content of the fuel and the type of burner employed in combusting the fuel in the boiler. A higher moisture content will require more time to dry to ignition, delaying ignition. A wetter hog fuel will, in such cases, have to have more fines content, if time to ignition is limiting. The fuel of the invention is specificially designed for use in a swirl stabilized air suspension burner which is well known commercially, particularly for burning pulverized coal.

A fines portion including at least 15% by weight less than 150 microns was found suitable for the burner shown in FIG. 2. The fuel size distribution is a critical element of the invention. A distribution of about 100% minus 1000 microns and 50% minus 150 microns is a preferred fuel specification where burner characteristics are not optimized for operation on wood.

In sum, the balancing of fuel moisture content, particle size distribution, and the manner in which fuel is mixed with combustion air and injected into the furnace, e.g. burner type, defines a method of fuel preparation and burning which eliminates any need for supporting fossil fuel for stability, which is a prime limiting characteristic of the prior art. Moisture content and size distribution are not independent, but may be adjusted so long as reactive fuel is produced that is adequate for the burner utilized. The complete air suspension burning of the fuel permits furnace operation without the necessity of a grate and has good capability to follow boiler load demand variations. The process is operable for all furnace configurations, kilns and the like, but is most particularly suitable for use with water wall furnaces and boilers, in contrast to prior art systems.

DESCRIPTION OF THE PREFERRED EMBODIMENTS

Figure 1:
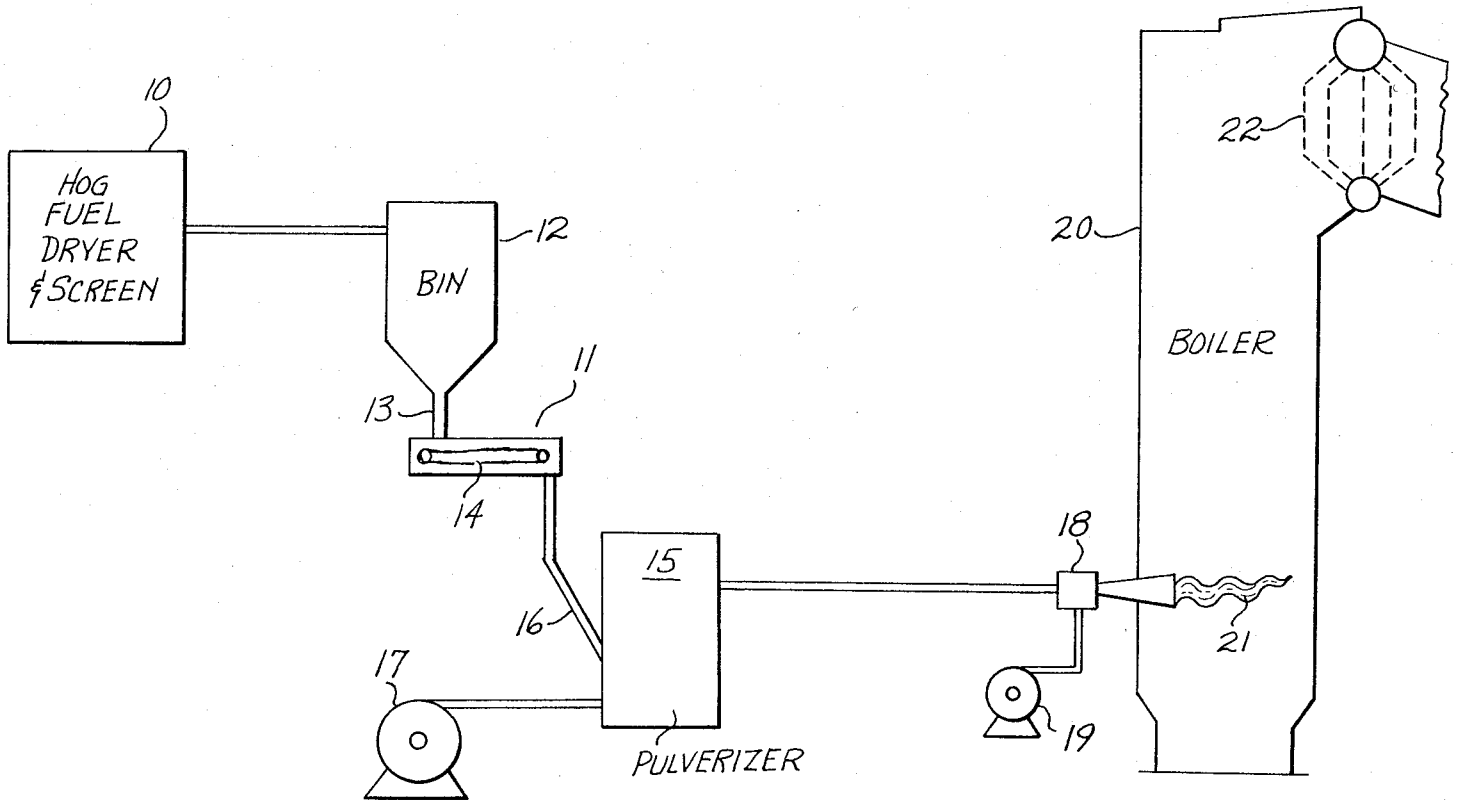
FIG. 1 is a schematic diagram of the method of invention for burning pulverized hog fuel in a water walled heat recovery means.

Referring to FIG. 1, hog fuel from the mill pile, typically at 60% moisture, comprising a mixture of wood ranging from sander dust through large log handling debris and bark is fed to a drying and screening process 10. A drying process similar to that disclosed by Spurrell in U.S. Pat. No. 4,335,174, cited and outlined above, may be used. The Spurrell patent is hereby incorporated by reference for the purpose of describing a suitable drying process for this invention. The Spurrell process is operated to produce a hog fuel having less than about 30% moisture content as required by the present invention. Final moisture content is a function of the operation of the dryer and the average particle size of the resulting dried fuel. In general, the Spurrell process produces material ranging from about 1½ by 4 inch (38–100 mm) chips to fines less than ⅛ inch in diameter (3175 microns). The moisture content of these particles may range from about 10% for the finer material up to about 30% for the larger chips.

The dried hog fuel is conveyed to a temporary surge storage and metering unit 11 which may be similar to a pulverized coal feeder. The hog fuel is initially held in a bin 12 designed to avoid "bridging" flow interruptions.

From the bin 12, the hog fuel is discharged through a column 13 onto a weighing belt means 14. Column 13 is of such a length as to impose an 80 psig explosion protection on the bin system 12. In other words, an explosion at the pulverizer would not propagate into the bin 12 because of the dimensions of the column 13. The fuel is transported through line 16 to a pulverizer 15. The metering system 14, in contrast to volumetric systems, provides a consistent, measured weight of hog fuel to the pulverizer, which weight of fuel may be varied over a wide range.

Pulverizer 15 is a high speed rotary hammer mill. A preferred machine is manufactured by Pulverizing Machinery Division of Mikropul Corp. of 10 Chatham Road, Summit, N.J. and is described by Duychinck, et al. in U.S. Pat. No. 3,285,523.

The fuel preparation and burning methods of this invention are designed to burn the fuel in air suspension, using a swirl stabilized burner. In such a system the amount of air for pulverizing, provided by a fan 17, is preferably limited to just that amount necessary to transport the fuel into the furnace ignition zone. Thus, a preferred pulverizer would produce the pulverized fuel suspended in a minimal amount of air, about 1–2 kilograms air per kilogram of fuel, to match fuel burner needs.

The transport or primary air carries the fuel through a burner 18 injecting it into the boiler 20 combustion zone 21. Secondary air is introduced by air pump 19 into the burner 18 along with the fuel. Boiler load or mill demand is depicted by water-filled heat transfer tubes 22 which in actual construction substantially surround the burner flame 21.

A key parameter of the process of the invention is the burner 18 which injects the dried pulverized hog fuel into the furnace and mixes it with air such that the fuel is substantially completely burned in suspension. A swirl stabilized burner, of the type used to burn pulverized coal in air suspension, was the starting point for the design of a burner suitable for burning the pulverized hog fuel. Some routine modification of the coal burner geometry was necessary to derive proper velocities, momentums and trajectories to insure complete suspension burning for the substantially different hog fuel feed.

Figure 2:
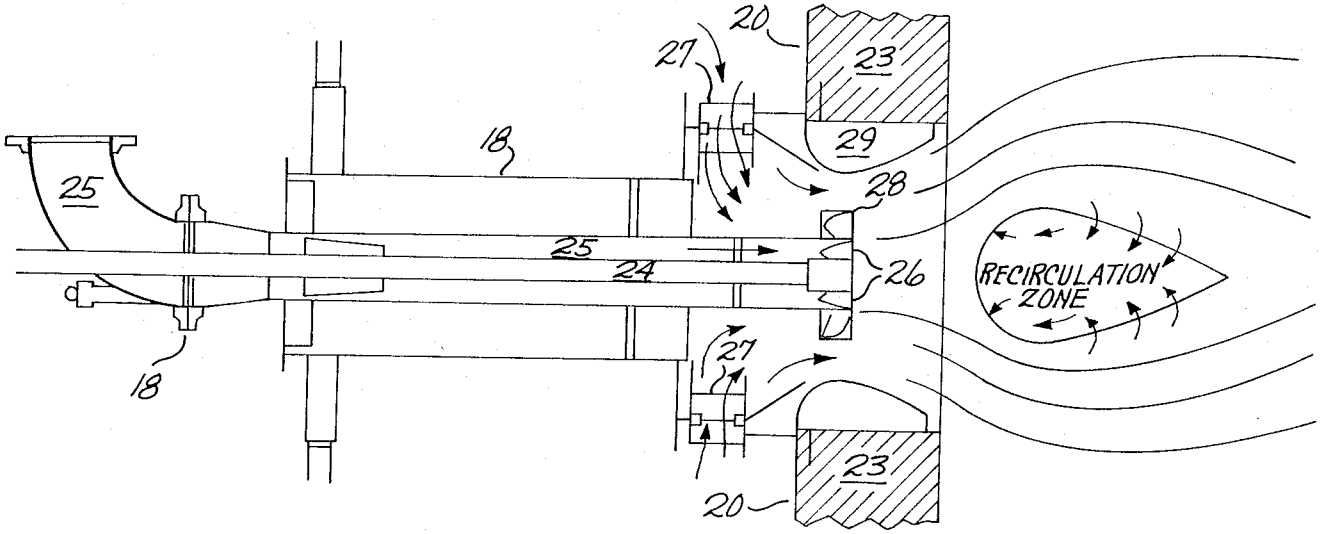
FIG. 2 is a schematic drawing of a swirl stabilized burner suitable for combusting the dried, pulverized fuel.

FIG. 2 depicts a swirl stabilized burner 18 of the type generally suitable for use with the fuel prepared by the methods of this invention. The burner 18 is installed in an aperture in the wall 23 of boiler 20. An oil nozzle igniter 24 is provided for flame initiation and start-up. A pipe 25 concentric about the oil pipe 24 transports dried, pulverized hog fuel and primary combustion air from the pulverizer into the boiler. Primary swirler vanes 26 impart angular momentum to the fuel and primary air stream as it leaves the burner 18 and is injected into the boiler 20.

Secondary combustion air generated by air pump 19 (see FIG. 1) enters the burner 18 through an air register 27 which can vary the amount of air admitted and the degree of swirl imparted to the air. Secondary swirler vanes 28 also impart angular momentum to the secondary air. The ratio of the opening area between the burner fuel pipe 25 and the boiler entry wall tiles 29, commonly called "blockage", also partly determines secondary air flow characteristics into the boiler.

The impact of swirl and blockage on this secondary air flow results in creation of a recirculation zone (see FIG. 2) where combustion products and heat flow back into contact with fresh fuel discharging from the fuel pipe 24. The high heat level of the combustion products raises the temperature of part of the entering fuel, primary and some secondary air to ignition temperature. The fines portion of the fuel ignites, providing ignition energy for the balance of the fuel before it can leave the flame area.

The presence of the fines portion as an ignition energy source imparts stability to the flame. The presence of the fines portion is the heart of the invention. The fines portion eliminates the requirement for continual running with supplemental oil in order to obtain burner stability which is typical of the prior art. The determination of burner stability is related to burner flame detection. When an insufficient signal from the flame is obtained by a detection safety device, shutdown of the furnace operation occurs. Such a shutdown is deemed sufficient evidence to warrant an unsatisfactory or "unstable" furnace condition conclusion.

A preferred burner is characterized as having a high blockage ratio, i.e., the ratio of primary burner area to throat area, and low swirl. The principal goal of the combination of swirl and blockage is generation of the recirculation zone. Also, mixing of secondary air with the primary stream occurs only as fast as needed for combustion. Limiting secondary air mixing avoids adding an excessive amount of "cold" air which would delay ignition. The high swirl and secondary tip swirler 28 cause very wide, short flames with furnace gas recirculation.

A major advantage of the process and equipment of this invention is the ability of the system to respond to varying mill steam or other heat load demands. The burners of the invention may be turned down below 100% capacity. The system of the invention is capable of at least a 2.5:1 turndown ratio. That is, the burner, in response to load changes, may be turned down to 100/2.5 or 40% of maximum output. Below the 2.5 turndown level the burner operation is generally unstable as the recirculation zone collapses.

The primary air to fuel ratio at 100% load of 1–2 kilograms air per kilogram of fuel or 16–32% of stoichiometric air for complete combustion is required for best combustion of the dry pulverized fuel in the boiler. At low load or fuel flows the ratio of air to fuel increases to 3:1. It is preferred to use the minimum amount of primary air to minimize the amount of "cold" air which must be heated with the fuel to reach ignition temperature.

Prior to this invention, a bin system would be interposed between the pulverizer 15 and the burner 18 to provide the required primary air/fuel ratios. This was true because all existing pulverizer designs required air to fuel ratios on the order of 3 kg air/kg fuel at high load and 8 kg air/kg fuel at low load or 50–150% of stoichiometric. Such high air to fuel ratios render a burner directly connected to such a pulverizer incapable of adequate turndown.

Figure 3:
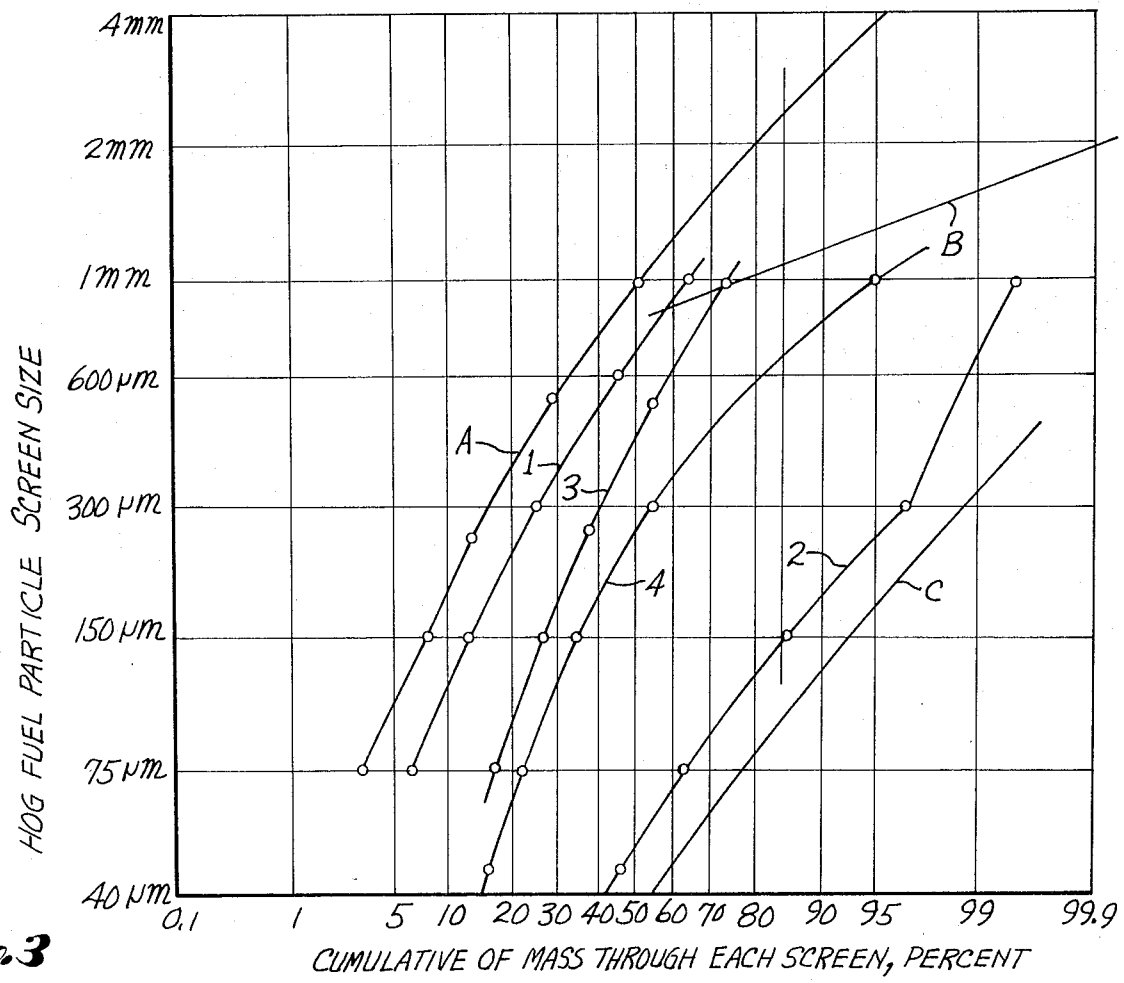
FIG. 3 is a series of particle size distribution curves characterizing a range of dried, pulverized fuels suitable for use in the process of this invention with a burner of the type shown in FIG. 2 and some prior art fuels.

The principal critical element of this invention is the particle size distribution of the dried hog fuel fed to the burner. FIG. 3 shows a series of pulverized hog fuel particle size distributions, including a range of fuels that are embodiments of this invention, and three lettered prior art fuel distributions. A basic conclusion established by this invention is that hog fuels must be substantially reduced in size to provide an ignition energy source in order to burn in suspension without oil support. A further conclusion reached through experimentation was that all the dried, pulverized wood fuels described in the prior art are too coarse to burn in a water wall or cold boiler without supporting fossil fuels.

Referring to FIG. 3, curve A is the fines portion of the hog fuel produced by the drying and screening process of Spurrell, described in U.S. Pat. No. 4,235,174. Attempts to burn this fuel in a water walled boiler without some oil fuel to support combustion were unsuccessful. Thus, curve A fuel is somewhat finer than the pulverized hog fuel of Baardson described in U.S. Pat. No. 3,831,535 as successfully burned in a refractory lined combustion chamber. The Baardson fuel was characterized as having a maximum particle size of 5/16 inch in diameter (7940 microns) igniting due to the high temperature at the wall's surface, which may be in the range between 2,200°–2,400° F. If Baardson's fuel were plotted on FIG. 3, it would fall somewhat to the left of curve A which it is believed is representative of the prior art fuels, incapable of combustion in air suspension in a cold walled combustion chamber without supporting fossil fuel.

Curve B is another prior art fuel, described by Fagerland, cited above at page 4, as typical of the Eneroth (Flakt, Inc.) and ASSI fuels. This fuel also proved unstable in combustion trials as it was too coarse.

Curve C is a pulverized coal sample of the prior art, substantially finer than hog fuels.

Curves 1 and 2 substantially define the dried, pulverized hog fuels of this invention. The fuel particle size distribution must be such that the fuel as a whole is self-igniting and thus burns in a cold walled combustion chamber. Fuels having size distributions which fall between Curves 1 and 2 are within the limits of the invention. Successful fuels must have distributions of coarse and fine portions substantially similar to Curves 1 and 2. That is, the slope of an acceptable fuel distribution must approximate those of Curves 1 and 2. A top size limit of about 65–100% of less than 1 mm (1000 microns) will insure sufficient "burnout" or combustion in the boiler during the available residence time to meet emissions requirments. The lower limit or fines portion expressed as at least 15% less than 150 microns is required to insure stable burning conditions. Fuels much finer than 85% less than 150 microns are likely to be too "dusty", increasing dust explosion hazards and otherwise requiring an excess of pulverizing power to produce.

Curves 3 and 4 are the size distributions of the fuels employed in the example detailed delow.

In some circumstances, characteristics and operating conditions may be adjusted to burn fuels that only marginally meet the fuel specification requirements of this invention. For example, certain coarse range fuels may be more stably burned without oil support if the transporting air is heated several hundred degrees. Tests indicate that while stability of a marginal fuel is improved, the effect is not large enough to allow stable combustion of "as is", i.e., unpulverized fuels such as those produced by the Spurrell process fines screen on the order of 3000 microns in size. Heating transport air improves burnability through (1) decreasing moisture content of the fuel particles at the burner; (2) increasing initial temperature at the fuel/air jet; and (3) allows operation at decreased primary to secondary momentum ratios.

Reduction of moisture of marginal fuels may help stabilize combustion, but a reduction much beyond 10% by weight moisture content is likely to be unsafe as an explosion hazard.

Varying fuel characteristics can effect pulverizer performance. High wood to bark ratios can substantially increase power requirements.

In comparison with coal, wood, being of a fibrous nature, is relatively difficult to pulverize. Wood pulverizing requires a high impact type pulverizer in contrast with crushers typically used to pulverize coal. Grinding wood requires power usages on the order of 25 kw/hr for bark and 50–80 kw/hr per ton for fuels having a large percentage of fiber while coal may require only 10–15 kw/hr. Experiments demonstrated that wood was easiest to grind when dry.

In experiments, various mixtures of wood fiber and bark were pulverized at various levels of moisture. Grinding performance was measured by the pulverizing industry's method of determining the amount of new particle surface area generated per unit power input, that is $m^2$/kw/hr. Achieving the fuel distribution of this method by practicable means requires first drying and then pulverizing.

A key advantage of the process of this invention is the arrangement whereby the fuel is first dried to less than 30% moisture by weight and then pulverized. The reverse arrangement, as adopted, for example, by Eneroth and described by Fagerland, cited above, requires twice the size or number of machines to accomplish a given production rate and even more importantly four times the power, which is a critical operating expense in the pulverizing arrangements.

Figure 4:
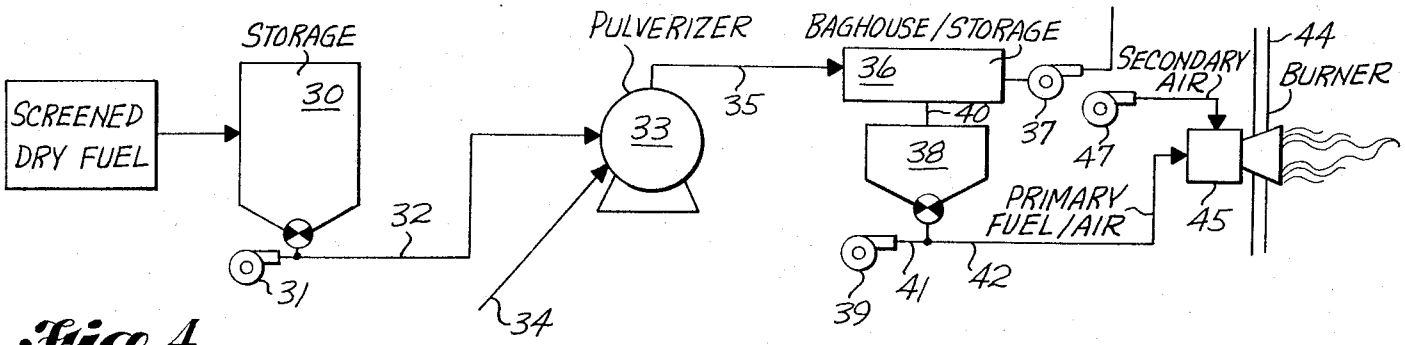
FIG. 4 is a schematic embodiment of the invention wherein pulverized fuel is temporarily held in storage before combustion.

FIG. 4 shows a schematic of an operating hog fuel heat recovery process in which there is intermediate storage of dry pulverized hog fuel prior to firing into the boiler. The hog fuel, dried according the Spurrell process, for example, is collected in a first storage bin 30. From bin 30 the material is mixed with air provided by blower 31 for transport in line 32 into a pulverizer 33. Make up air 34 is drawn into the pulverizer 33 by a fan 37 as needed to satisfactorily move the hog fuel through the pulverizing process. The pulverized hog fuel and air discharges through a transport line 35 to a bag house dust collector 36. The carrier air is discharged through fan 37. The pulverized dried hog fuel drops into conveyor 40 which delivers the fuel to storage/surge bin 38. Hog fuel is then fed to boiler 44 as needed by mill process heat demands. Fuel, as required, is combined with air 41 supplied by primary air fan 39. The air-fuel mixture 42 is injected into boiler 44 through a suspension burner 45. Such secondary air as is necessary for combustion is supplied by conventional boiler air system 47.

In certain retrofit situations, it may be necessary to use the intermediate bin storage process of FIG. 4 which may require additional capital cost. A disadvantage of the bin system is that it presents a much higher dust explosion hazard than the direct fire approach. Thus, explosion detection and suppression instrumentation and equipment are necessary parts of the bin approach. The bin-firing system is actually an intermediate step in developing a system which would permit firing pulverized fuel directly from the pulverizer.

EXAMPLE

The following tables describe typical fuel, air flows and certain other conditions characteristic of the operation of the process shown in FIG. 4. The process operates completely without oil support.

The drying process described by Spurrell in U.S. Pat. No. 4,235,174 provides dry, screened feed for this heat recovery process production run.

The system provides fuel to two burners, similar to the burner 45 shown in FIG. 4.

The boiler is a water wall furnace wherein the heat recovery portion of the boiler comprises surrounding the combustion zone with water filled elements for capturing the heat.

The pulverizer was a standard Mikro-ACM# Pulverizer, Model 200 with internal classifier manufactured by Pulverizing Machinery Division of MikroPul, U.S. Filter Corporation of Summit, N.J. The pulverizer machine was fitted with a 300 horsepower motor producing air to fuel ratios of 2.8:1 at high pulverizer loads and 8.1:1 at low loads. With these air flows, the intermediate bin was necessary to obtain turndown capability of the boiler.

TABLE

Suspension Burning of Pulverized Hog Fuel - Summary of Process Flows Referring to FIG. 4.

| Location - FIG. 4 | Parameter | | Relative Fuel Feed Rate, Single Burner Low | High | High |
|---|---|---|---|---|---|
| Pulverizer Feed Streams | | | | | |
| Pulverizer Feed at 32 - Hog Fuel | Moisture | (%, wt. $H_2O$/wt. $H_2O$ + wt. wood) | 15 | 15 | 30 |
| | Mass Rate | (kg/h) | 805 | 2,410 | 1,300 |
| | Volume Rate | ($m^3$/h) | 4.25 | 12.75 | 5.66 |
| Blower Outlet at 31 - Air | Mass Rate | (kg/h) | 2,990 | 2,990 | 3,060 |
| | Volume Rate | ($m^3$/min.) | 37.65 | 37.65 | 38.50 |
| | Temperature | (°C.) | 35 | 35 | 35 |
| | Velocity | (m/s) | 30.5 | 30.5 | 31.2 |
| Pulverizer Inlet at 34 - Air | Mass Rate | (kg/h) | 20,300 | 20,260 | 20,190 |
| | Volume Rate | ($m^3$/min.) | 272 | 271 | 270 |
| | Temperature | (°C.) | 10 | 10 | 10 |
| Pulverized Streams | | | | | |
| Pulverizer Outlet at 35 - Hog Fuel and Air | Volume Rate | ($m^3$/min.) | 368 | 368 | 368 |
| | Velocity | (m/s) | 25 | 25 | 25 |
| Baghouse Outlet at 37 - Air | Mass Rate of Gas | | | | |
| | Dry Air | (kg/h) | 23,100 | 23,000 | 22,950 |
| | Water | (kg/h) | 190 | 250 | 300 |
| | Volume Rate | ($m^3$/min.) | 368 | 368 | 368 |
| | Temperature | (°C.) | 38 | 38 | 38 |
| | Dew Point | (°C.) | 21 | 23 | 25 |
| Baghouse Outlet at 40 - | Fuel Moisture | (%, wt. $H_2O$/wt. $H_2O$ | 12 | 12 | 22 |

TABLE-continued

Suspension Burning of Pulverized Hog Fuel - Summary of Process Flows Referring to FIG. 4.

| Location - FIG. 4 | Parameter | | Relative Fuel Feed Rate, Single Burner Low | High | High |
|---|---|---|---|---|---|
| | | + wt. wood) | | | |
| Hog Fuel | Mass Rate | (kg/h) | 775 | 2,325 | 1,160 |
| | Volume Rate | ($m^3$/h) | 2.84 | 8.52 | 4.25 |
| Burner Streams | | | | | |
| Flow to Burner at 42 - | Mass Rate | (kg/h) | 775 | 2,325 | 2.325* |
| Hog Fuel | Volume Rate | ($m^3$/h) | 2.84 | 8.52 | 4.25 |
| Flow to Burner at 41 - | Mass Rate | (kg/h) | 1,240 | 1,240 | 1,240 |
| Primary Air | Volume Rate | ($m^3$/h) | 18.3 | 18.3 | 18.3 |
| | Temperature | (°C.) | 35 | 35 | 35 |
| | Velocity | (m/s) | 15.2 | 15.2 | 15.2 |
| Flow to Burner at 42 - | Volume Rate | ($m^3$/h) | | | 51.3 |
| Primary Air After Heating | Temperature | (°C.) | 250 | 250 | 315 |
| | Velocity | (m/s) | | | 46.0** |
| Flow to Burner at 47 - | Mass Rate | (kg/h) | 4,433 | 14,798 | 15,070 |
| Secondary Air | Temperature | (°C.) | 250 | 250 | 250 |
| | Velocity | (m/s) | 30 | 30 | 30 |
| Steam Production | | | | | |
| Total steam from pulverized fines (kg/h) | | | 4,210 | 12,630 | 12,460*** |
| Swing load range with pulverized fines (kg/h) | | | — | 8,420 | 8,420 |
| As % of boiler rating | | | | 10 | 10 |

*Note: In high rate moisture case, pulverizer cannot meet capacity of burner. Starting with a full bin, the burner can be operated at full load for only 2.5 hours.
**Note: This is the velocity before mixing with fuel. ΔT across mixing tee is approximately 170 C. At the burner inlet, the temperature is 80° C., and the velocity has dropped to 29.3 m/s.
***Note: 75% efficiency; 74% efficiency for high rate, high moisture case.

Figure 5:
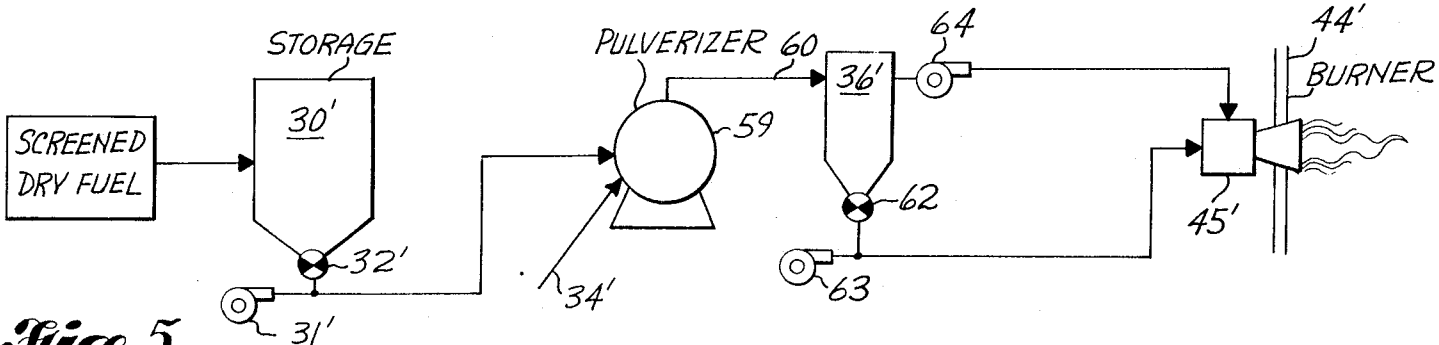
FIG. 5 shows an alternative arrangement of the invention wherein a separator is used to concentrate the fuel and a portion of the separated air is used for secondary air makeup.

FIG. 5 shows an alternative arrangement wherein high air flow pulverizer 59 discharges a fuel-air mixture 60 to a baghouse or cyclone 36'. A portion of the air stream exiting the baghouse or cyclone 36' is used as secondary air 64 for the burner 45'. Fuel discharges from bin or cylone 36' and is entrained with air provided by the primary air fan 63.

It is to be understood that a number of parallel dryers, pulverizers and burners may be needed to meet the entire load of a boiler energy recovery system. For example, it is contemplated that one pulverizer will be required for every 100–200 million BTU per hour of hog fuel burned.

We claim:

1. A process for burning a wet organic fuel in a water wall or other cold wall type boiler which comprises:

providing at least one swirl stabilized burner adapted for burning a powdered fuel;

drying the wet fuel to an average moisture content less than about 30% with at least a portion of the finer particles having a moisture content not exceeding about 20%;

pulverizing the dried fuel so that at least 60% by weight of the particles are finer than about 1000 microns and at least 15% of the particles are finer than about 150 microns, adjusting the fraction of the less than about 150 micron particles in the pulverized portion so that the fuel will produce a self-sustaining flame;

conveying the dried and ground particles to the burner while suspended in a stream of primary air; and igniting the particles, whereby the less than about 150 micron fraction provides sufficient ignition energy to sustain stable combustion of the entire fuel.

2. The process of claim 1 in which essentially all of the particles are less than 1000 microns and at least 50% by weight are less than about 150 microns.

3. The process of claim 1 in which the average fuel moisture is less than about 20%.

4. The process of claim 1 in which the burner has a high blockage ratio to minimize mixing of secondary air with the primary air-fuel stream.

5. The process of claim 1 in which the organic fuel is wood waste comprising wood and bark particles.

6. The process of claim 1 in which the organic fuel is peat.

7. The process of claim 1 employing a weight ratio of primary air to fuel in the range of 1–3 kg of air for each 1 kg of fuel.

8. The process of claim 1 in which the wet fuel is first screened prior to drying so that the largest particles being dried do not exceed more than about 100 mm in any dimension.

* * * * *

UNITED STATES PATENT AND TRADEMARK OFFICE

CERTIFICATE OF CORRECTION

PATENT NO. : 4,532,873

DATED : August 6, 1985

INVENTOR(S) : John Rivers, Charles D. Kramer, Robert L. Cox

It is certified that error appears in the above—identified patent and that said Letters Patent is hereby corrected as shown below:

In Claim 1, line 9, "60%" should read -- 65% --

Signed and Sealed this

Fourteenth Day of October, 1986

[SEAL]

*Attest:*

DONALD J. QUIGG

*Attesting Officer*

*Commissioner of Patents and Trademarks*